US007866750B2

(12) United States Patent
Bock

(10) Patent No.: US 7,866,750 B2
(45) Date of Patent: Jan. 11, 2011

(54) PERMANENT CONTACT MECHANISM

(75) Inventor: Hermann Bock, Pyrbaum (DE)

(73) Assignee: Bock 1 GmbH & Co. KG, Postbauer-Heng (DE)

( * ) Notice: Subject to any disclaimer, the term of this patent is extended or adjusted under 35 U.S.C. 154(b) by 0 days.

(21) Appl. No.: 12/160,839

(22) PCT Filed: Jan. 12, 2006

(86) PCT No.: PCT/EP2006/000249

§ 371 (c)(1),
(2), (4) Date: Oct. 6, 2008

(87) PCT Pub. No.: WO2007/087817

PCT Pub. Date: Aug. 9, 2007

(65) Prior Publication Data

US 2009/0066134 A1 Mar. 12, 2009

Related U.S. Application Data

(63) Continuation of application No. PCT/EP2006/000249, filed on Jan. 12, 2006.

(51) Int. Cl.
*A47C 1/024* (2006.01)

(52) U.S. Cl. ..... 297/303.3; 297/303.1

(58) Field of Classification Search ..... 297/303.3, 297/303.4, 303.5
See application file for complete search history.

(56) References Cited

U.S. PATENT DOCUMENTS

| | | | | |
|---|---|---|---|---|
| 3,072,436 | A * | 1/1963 | Moore | 297/316 |
| 3,339,973 | A * | 9/1967 | Doerner | 297/300.4 |
| 5,348,372 | A * | 9/1994 | Takamatsu et al. | 297/303.1 |
| 6,015,187 | A * | 1/2000 | Roslund et al. | 297/300.4 |
| 6,582,019 | B2 * | 6/2003 | Zwick et al. | 297/300.4 |

* cited by examiner

*Primary Examiner*—Sarah B McPartlin
(74) *Attorney, Agent, or Firm*—Laurence A. Greenberg; Werner H. Stemer; Ralph E. Locher

(57) ABSTRACT

A permanent-contact mechanism for an office chair or the like is formed as a comparatively flat permanent-contact mechanism with a seat frame, which can be positioned on a chair upright, with a backrest support, which is arranged on the seat frame such that it can be pivoted about a transverse axis, and with at least one spring-activated or inherently resilient lever element, which interacts with the backrest support such that the backrest support is always pivoted counter to a spring force. The position of the point of rotation of the lever element differs from the position of the transverse axis.

5 Claims, 13 Drawing Sheets

PERMANENT CONTACT MECHANISM

BACKGROUND OF THE INVENTION

Field of the Invention

The invention relates to a permanent contact mechanism for an office chair or the like.

Permanent contact mechanisms, also known as asynchronous mechanisms, are characterised in that a chair back is connected movably to a fixed seat. The chair back follows the movements of the seated person from a front (upright) to a rear ("lying") position and vice versa. Permanent contact mechanisms thus facilitate and support frequently changing seating positions which are preferred for orthopaedic reasons, i.e. due to the associated reciprocal weight bearing of invertebral discs.

To ensure secure and pleasant motion sequence the chair back pivots mostly against the force of a spring component. An adjustment option for changing the resilient force is often also provided. But the drawback to solutions known from the prior art is that the construction elements, such as for example worm gears, threaded rods etc. required for resilient force adjustment, considerably increase the necessary overall height of the permanent contact mechanism.

An aim of the present invention is to provide a comparatively low permanent contact mechanism.

This task is solved by a permanent contact mechanism according to the present invention. According to this a permanent contact mechanism is provided with a seat frame placeable on a chair column, with a chair back frame arranged pivotably about a transverse axis on the seat frame, with at least one spring-loaded or intrinsically resilient lever element which cooperates with the chair back frame such that pivoting of the chair back frame occurs constantly against a resilient force, whereby the position of the lever fulcrum of the lever element is different from the position of the transverse axis.

BRIEF SUMMARY OF THE INVENTION

A fundamental idea of the invention is the spaced positioning of the lever fulcrum of the lever element impacting the chair back frame on the one hand and on the other hand the position of the transverse axis, about which the chair back frame can be pivoted.

The result of this constructive arrangement is that the lever element moving with the chair back frame travels another travel distance than does the chair back frame. This forms the basis for a structurally very simple and thus economic resilient force adjustment which can also be made in the smallest space, in particular realizing a particularly small overall height of the permanent contact mechanism.

A further fundamental idea of the invention is to provide a resilient force adjustment without a resilient element having to be (pre)stressed. It has proven advantageous in particular if the length of the effective lever arm can be changed without effort having to be directed against the resilient force via a change in the position of the articulation point of a lever arm of the lever element on the chair back frame. Otherwise expressed, a particularly easy, "feeble" resilient force adjustment is made.

An exemplary embodiment of the invention with further advantageous configurations will now be explained hereinbelow in greater detail by means of the drawings, shown here partly simplified and schematically, in which:

DESCRIPTION OF THE INVENTION

Figure 1:
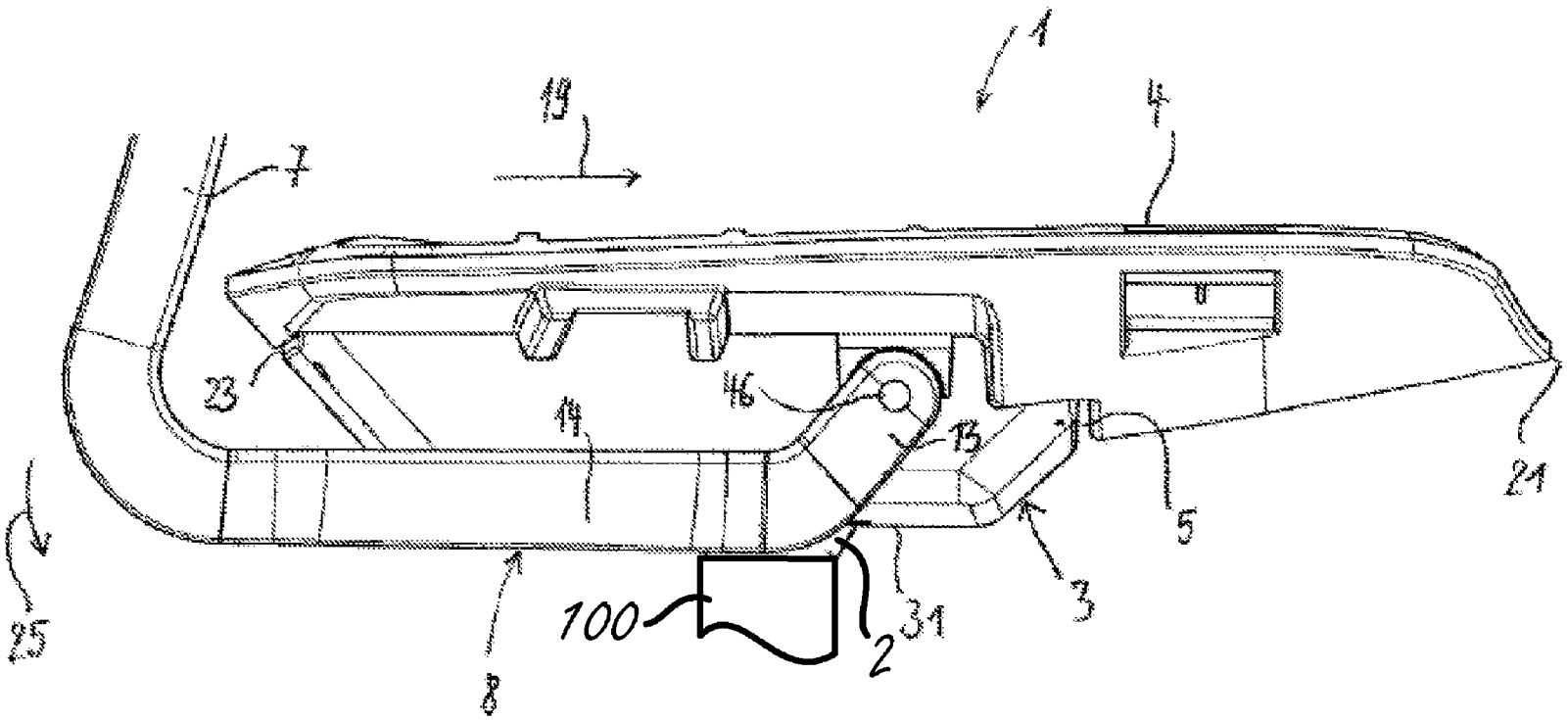
FIG. 1 shows a permanent contact mechanism in a side view.
Figure 2:
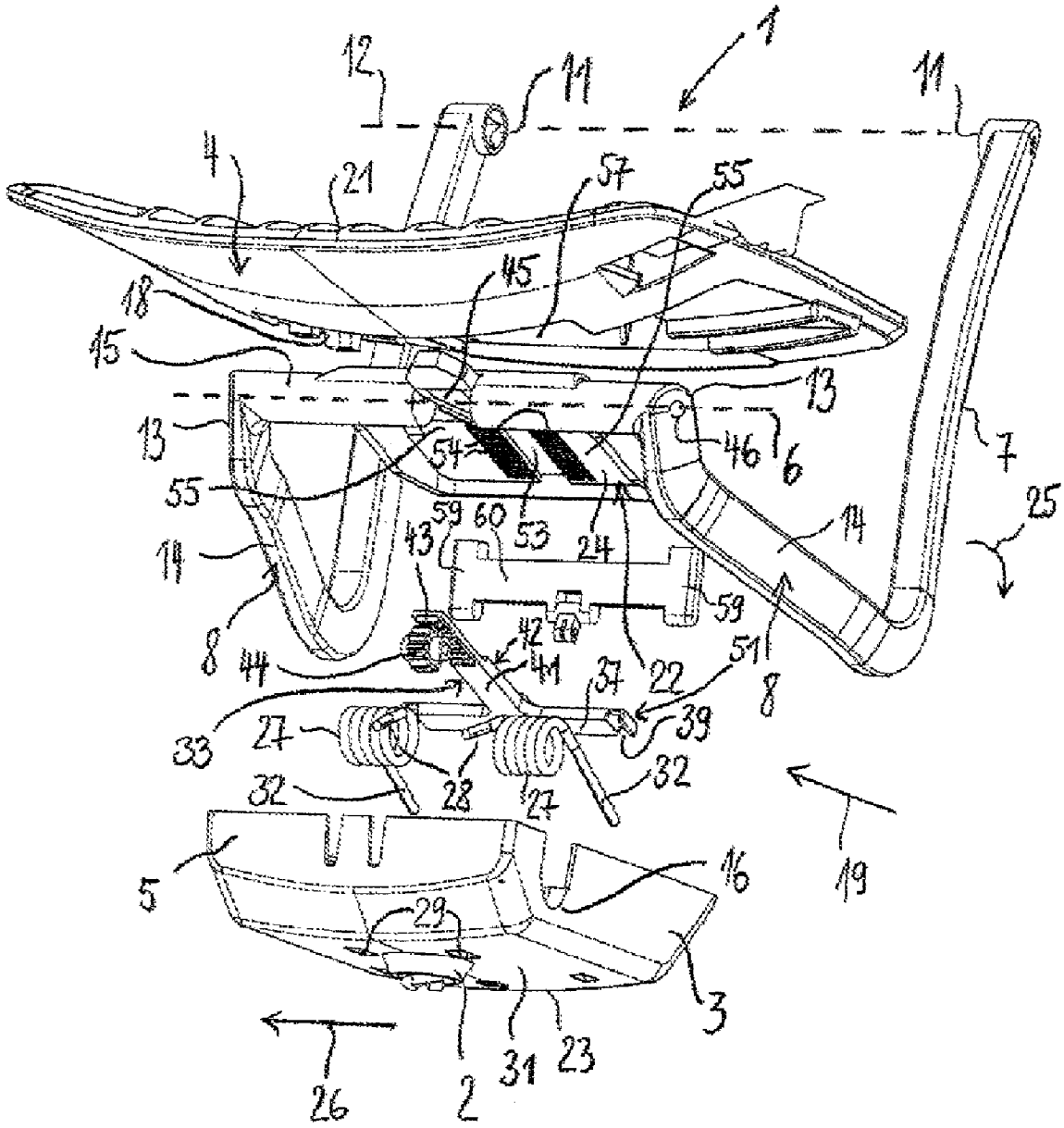
FIG. 2 shows a permanent contact mechanism in a first exploded illustration.
Figure 3:
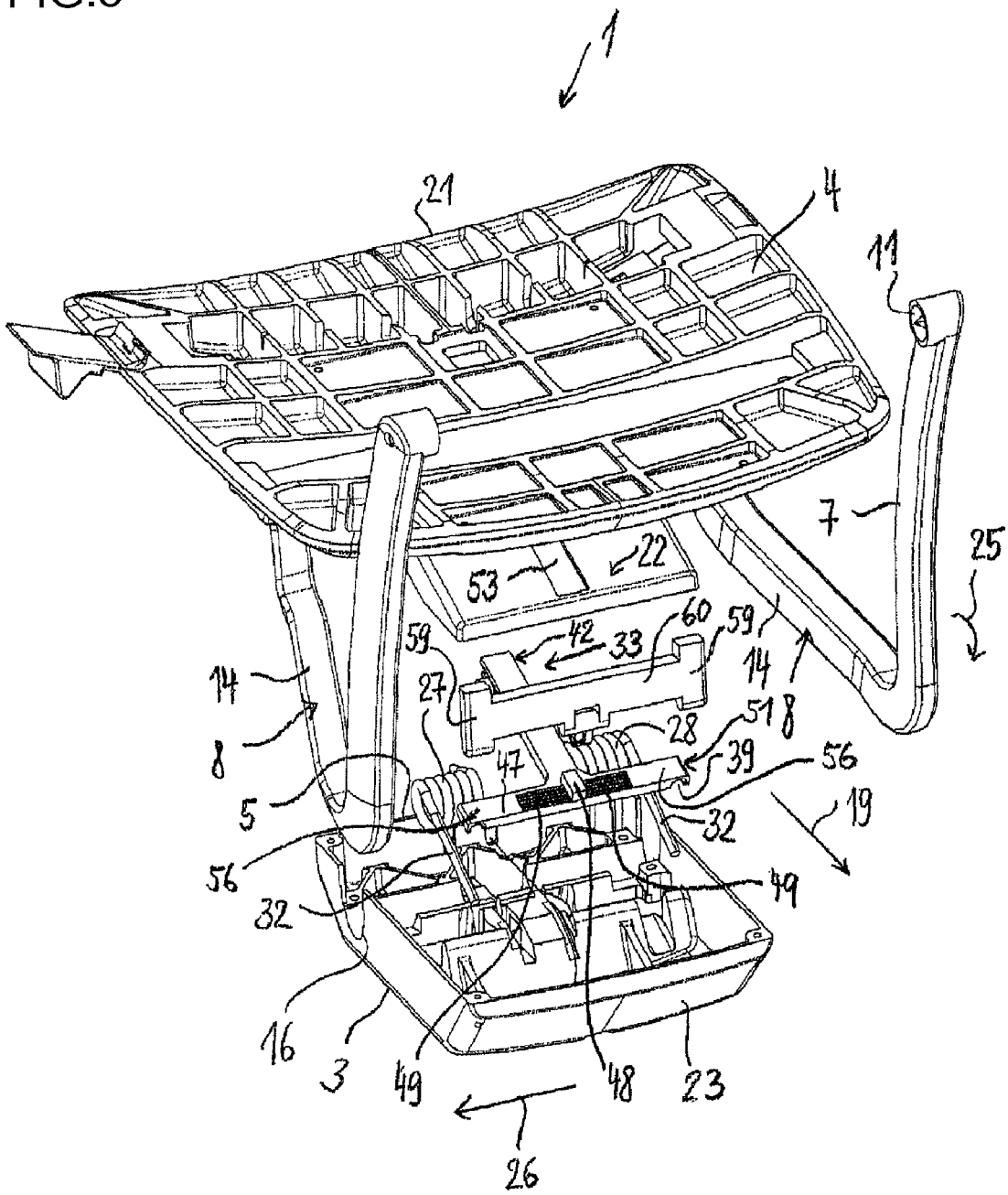
FIG. 3 shows a permanent contact mechanism in a second exploded illustration.

The exemplary embodiment shows a permanent contact mechanism 1 for an office chair or the like, with a fixed, i.e. immovable seat frame 3 placeable by means of a conical flange 2 onto the upper end of a chair column 100, and with a seat plate 4 attached to the seat frame 3, which together with the seat frame 3 forms a housing for the actual pivoting mechanism, cf. FIG. 1. In the process the seat plate 4 extends well out over the leading edge 5 of the seat frame 3. The seat frame is preferably made of a fibreglass-reinforced plastic material (Pa6Gf30), while the seat plate comprises polypropylene.

In addition, the permanent contact mechanism 1 includes a chair back frame 7 arranged pivotably about a transverse pivot axis 6 on the seat frame 3, fork-shaped in plan view, the bearers 8 of which are arranged on both sides of the seat frame 3. The seat fitted with an upholstered seat area is mounted on the seat plate 4; alternatively, a seat bearer or the like can also complete the seat frame 3 in an upward direction, instead of the seat plate 4 (neither shown).

As is evident in particular in FIGS. 2 to 6, the whole permanent contact mechanism 1 is built mirror-symmetrically with respect to a medium-length plane M(cf. FIG. 4), which relates to the actual kinematics. The following description is always based on paired construction elements of the actual pivoting mechanism.

Figure 4:
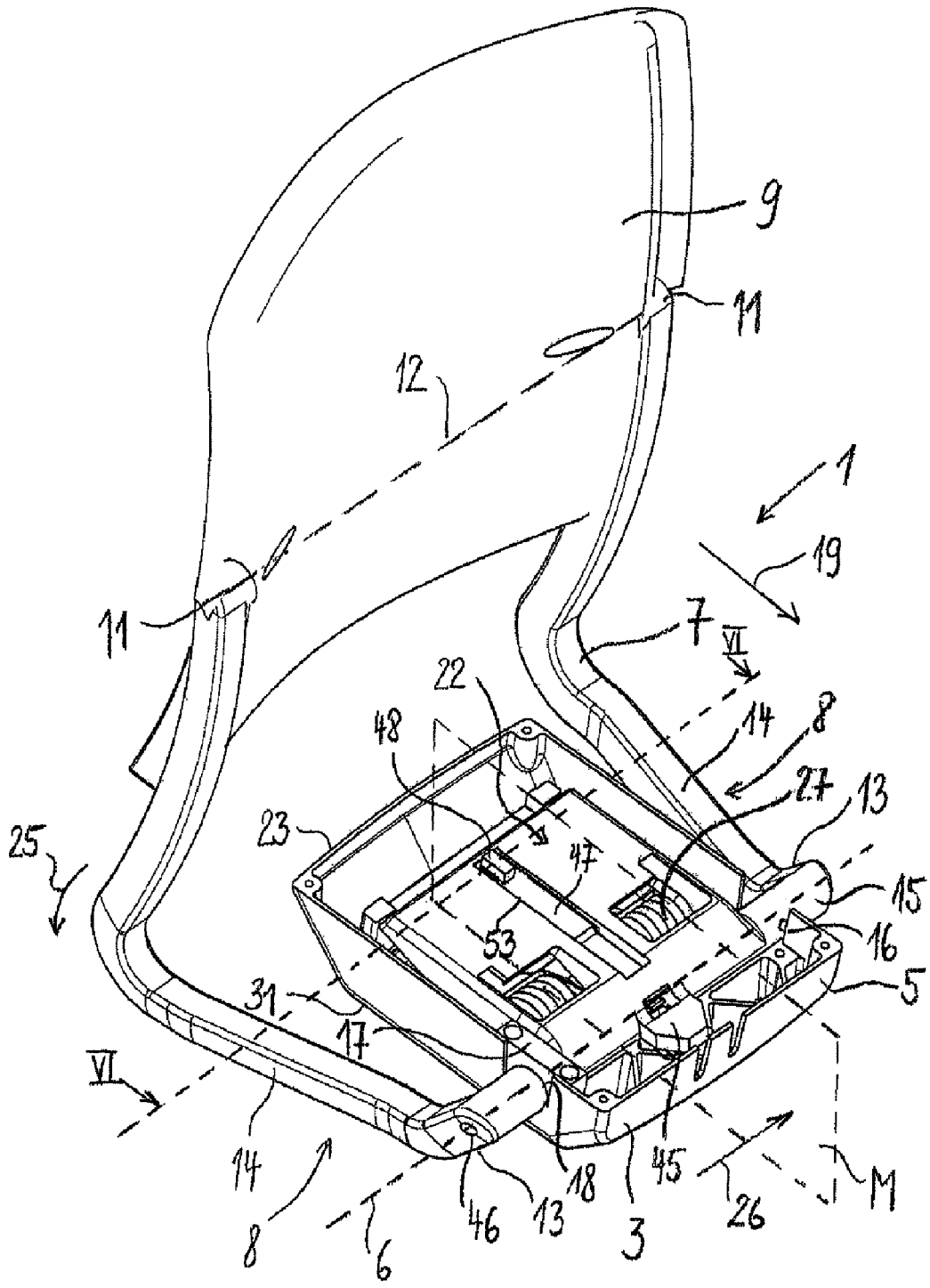
FIG. 4 shows a permanent contact mechanism without seat plate in a perspective view.
Figure 5:
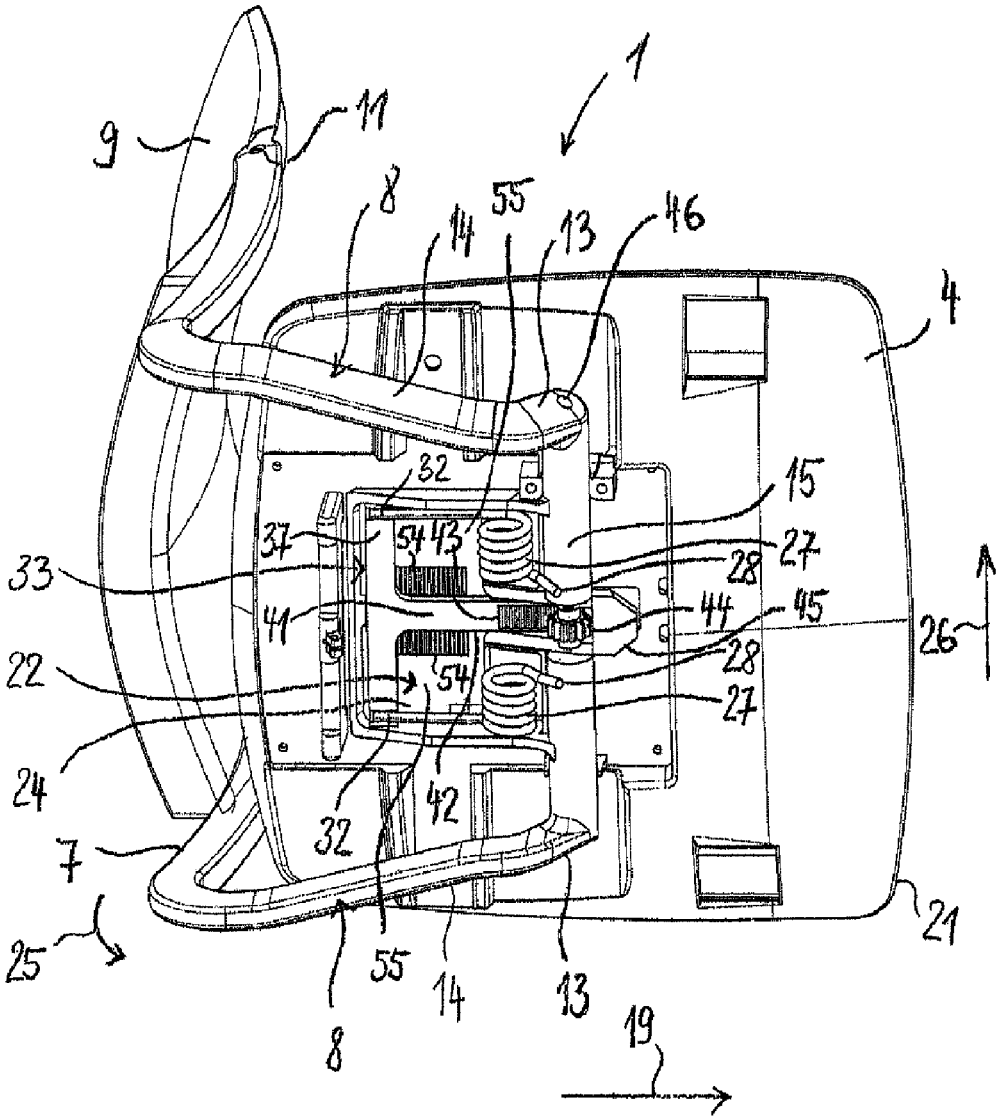
FIG. 5 shows a permanent contact mechanism without seat frame in a perspective view.
Figure 6:
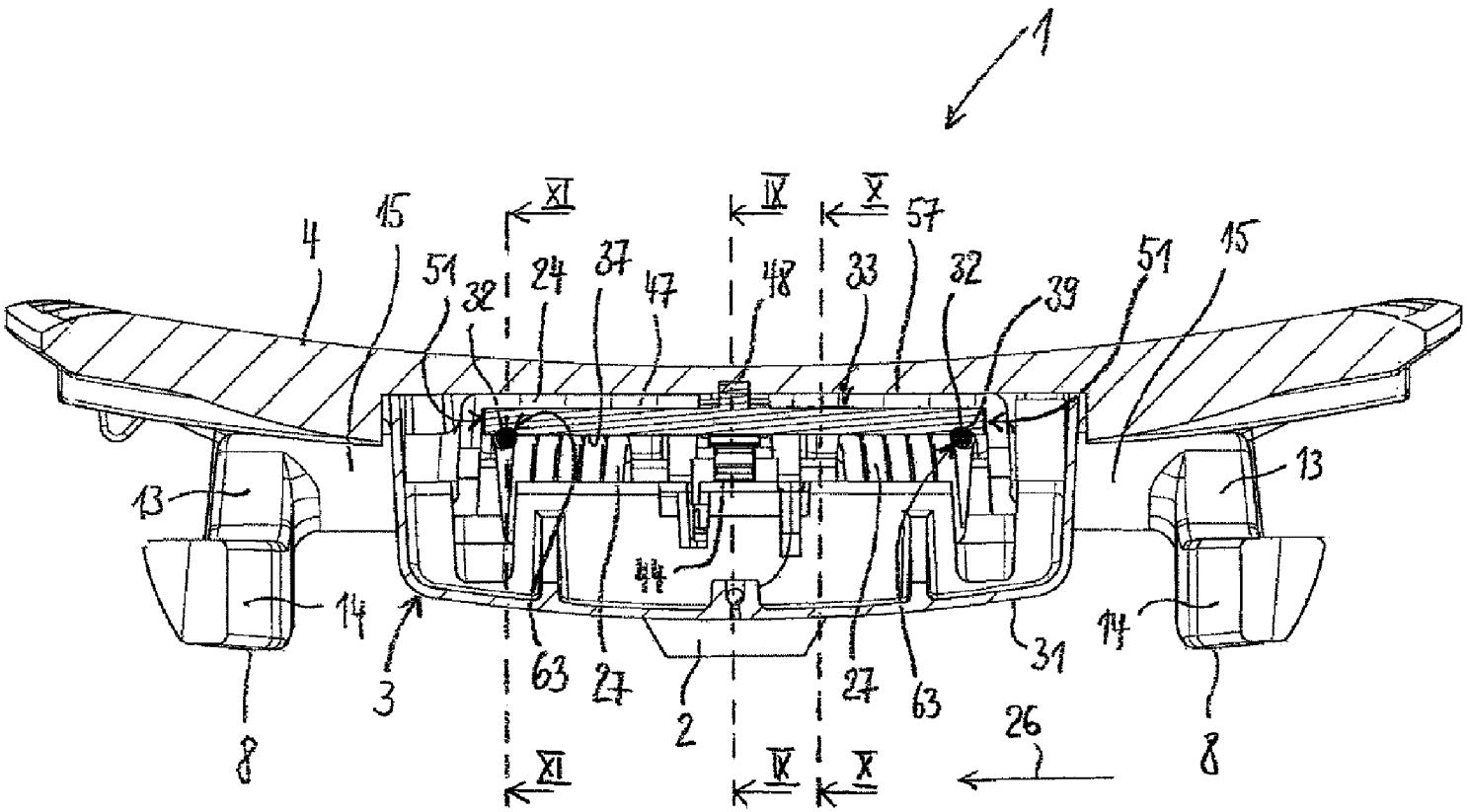
FIG. 6 shows a permanent contact mechanism in a sectional view along line VI-VI in FIG. 4.

Attached to the chair back frame 7 is a chair back 9, cf. FIGS. 4 and 5. For this, the upper free ends of the chair back frame 7 have a cradle 11 which is designed for pivotable bearing of the chair back 9 about a pivot axis 12, cf. FIG. 2. Otherwise expressed, the chair back 9 can perform a pendulum motion, serving to effectively prevent lordosis separation. In other words, the result is permanent contact of the lordosis region of the seated person with the chair back 9. This pivoting mechanism for the chair back 9 preferably also comprises a resilient element (not shown) for resetting the chair back 9 into its normal position, as soon as the seated person stands up. In order to perform the pendulum motion the seated person must therefore overcome a specific resilient force. The chair back is preferably made of plastic (Pa6).

The chair back frame 7 is articulated with the seat frame 3 to the front end 13 of its bearer 8, which runs obliquely upwards starting from a horizontal main bearer element 14, beginning approximately in the region of the conical flange 2. For this purpose, a hollow crossmember 15 connecting both bearers 8 lies in U-shaped recesses 16 provided on both sides of the seat frame 3 and is held there by corresponding parts 17 with likewise U-shaped recesses 18, arranged inside the seat frame 3 and mountable from above, cf. FIG. 4, whereby a pivot bearing is designed for the chair back frame 7.

The position of the pivot axis 6, about which the chair back frame 7 can be pivoted, and corresponding to the constructive edge parameter is in a position which effectively minimizes the so-called "shirt-pull effect". The pivot axis 6 is arranged not directly under the actual H point of the seated person, but is offset relative to the actual H point in the direction of the leading edge 5 of the seat frame 3. The pivot axis 6 is located in particular in a longitudinal direction 19, as viewed from the conical flange 2, therefore offset from the conical flange 2 in the direction of the seat leading edge 21. In addition, the pivot axis 6 is in the immediate vicinity of the seat plate 4 terminating the seat frame 3.

The crossmember 15 as integral part of the chair back frame 7 is connected integrally to a latch plate 22 which extends in the direction of the trailing edge 23 of the seat frame 3 and whereby at least its underside 24 runs parallel to the bearer main elements 14. This latch plate 22 performs every movement of the chair back frame 7 in the direction of pivoting 25 and at the same time moves inside the seat frame 3. The chair back frame 7 with all its components (latch plate 22, . . . ) is preferably made of Pa6Gf30.

Inside the seat frame 3 a spring arrangement is provided with two torsion springs 27 aligning with one another in a transverse direction 26. These are torsion springs with two legs in each case. The shorter fixed legs 28 point in the direction of the leading edge 5 of the seat frame 3 and are supported in specially provided openings 29 in the underside 31 of the seat frame 3, through which they protrude outwards. The longer free leg 32 points in the direction of the trailing edge 23 of the seat frame 3 and is supported on a contact slide 33, described in greater detail hereinbelow, acting mechanically reciprocally to the latch plate 22. The torsion springs 27 themselves lie in specially provided prisms 34, designed as part of the seat frame 3.

The torsion springs 27 thus form lever elements, cooperating with the chair back frame 7 such that moving the chair back frame 7 in the direction of pivoting 25 occurs constantly against the resilient force of the torsion springs 27. At the same time, both legs (fixed leg 28 and free leg 32) act as lever arms. The middle points 35 of the torsion springs 27 form the lever fulcrums of the lever elements and are spaced at a distance from the position of the pivot axis 6.

A particular advantage is a structural form realized with this exemplary embodiment, wherein the middle points 35 of the torsion springs 27 are at any time on a horizontal plane 36 (illustrated in FIG. 10) with the centre of the pivot axis 6, cf. FIGS. 10 to 15. This arrangement enables a minimal overall height of the permanent contact mechanism 8 and at the same time enables an adequate regulating range of the chair back frame, thus constituting an optimal centre path between overall height and regulating range.

A particular advantage also is a further structural form realized with this exemplary embodiment, wherein the middle points 35 of the torsion springs 27 are located directly over the conical flange 2 and thus directly over the chair column. The advantage is that all areas subject to a high force influence, specifically the conical flange 2 made of steel, the bearing (shaft 46, . . . ) of the chair back frame 7 as well as the bearing (prism 34) of the torsion spring 27, lie close together. A particularly stable construction can be achieved accordingly with particularly low material use.

The contact slide 33 arranged centrally in the seat frame 3 is designed substantially T-shaped and preferably comprises plastic (Pa6). On the undersides 37 of both its T-legs 38 running in a transverse direction 26 it has in each case a U-shaped groove 39 running in a longitudinal direction 19. In these grooves 39 lie the free legs 32 of the torsion springs 27. In other words, the free legs 32 of the torsion springs 27 are supported on the T-legs 38 of the contact slide 33.

Fixed to the underside 41 of the T base 42 of the contact slide 33 is a gear rack 43 which cooperates with a cog 44 to form a rack gear. The cog 44 is arranged in a specially provided recess 45 of the crossmember 15 and mounted on a shaft 46 running inside the crossmember 15 and at the same time acting as pivot axis 6 for the chair back frame 7. An actuating element (not shown), for example a hand wheel, is attached to an end of the shaft 46 for actuating the cog 44.

The top side 47 of the contact slide 33 cooperates with the underside 24 of the latch plate 22 as follows: at the point where both T-legs 38 of the contact slide 33 collide, therefore in a central position, is a cuboid block 48, projecting upwards from the top side 47 in the direction of the latch plate 22 or respectively seat plate 4, which is connected preferably in one piece to the contact slide 33 for reasons of improved mechanical strength and load-bearing capacity.

To the right and left of this block 48 on the top side 47 of the contact slide 33 a number of latch elements 49 is provided. At the same time, these are evenly spaced, cogged locking steps, arranged in the transverse direction 26. These extend in the direction of the free ends 51 of the T-legs 38 as far as approximately the middle of the T-legs 38, so that the top sides 52 of the T-legs 38 are free of the latch elements 49 in the region of their free ends 51 and exhibit smooth surfaces corresponding to the material selected.

Down the middle the underside 24 of the latch plate 22 has a rectangular opening 53 running in the longitudinal direction 19. A number of latch elements 54 again extends on both sides of the opening 53 in the longitudinal direction 19. These are designed as counter-elements to the latch elements 49 on the top side 47 of the contact slide 33. Again corresponding to the selected material the surface is smooth on both sides of the latch element 54, therefore on the lateral edge regions 55 of the underside 24 of the latch plate 22.

Contact slide 33 and latch plate 22 are arranged relative to one another such that the block 48 arranged on the top side 47 of the contact slide 33 never contacts the latch plate 22, but is arranged constantly in the region of the rectangular opening 53.

When the chair back frame 7 swivels into a rear position the free "active" legs 32 of the torsion springs 27 cover a longer distance than the chair back frame 7. The swivel movement of the free legs 32 occurs in other words over a greater range of angle than the swivel movement of the chair back frame 7. At the same time, shearing forces occur in the construction elements concerned.

Figure 7:
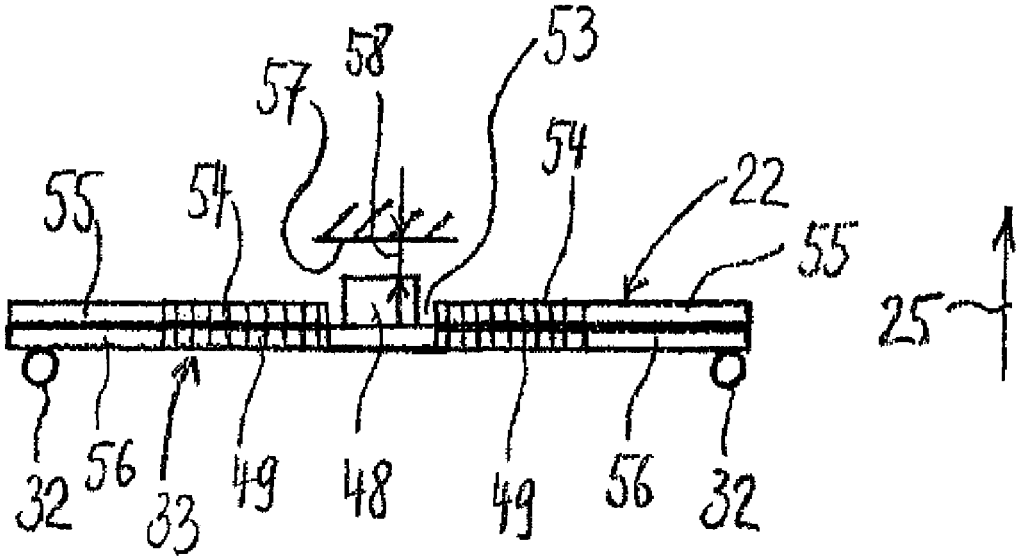
FIG. 7 shows a schematic illustration of the position of the contact slide in a rear position.

If the chair back frame 7 is in a pivoted, rear position (cf. FIGS. 12 and 14), the force constituents of the torsion springs 27 acting on the contact slide 33 in the direction of the trailing edge 23 of the seat frame 3 are greater than the frictional forces between the smooth surfaces on the top side 47 of the contact slide 33 and the underside 24 of the latch plate 22. According to the invention therefore the latch elements 49, 54 of contact slide 33 and latch plate 22 in this position are meshed in one another and form a self-arresting latch pawl, cf. FIGS. 7 and 10. The shearing forces can be absorbed, whereby the mechanical stability of the construction in a pivoted chair back frame 7 is guaranteed. At the same time, the smooth outer regions 56 of the T-legs 38 of the contact slide 33 rest on the smooth edge regions 55 of the latch plate underside 24.

As a result this means that the contact slide 33 can no longer be moved in a longitudinal direction 19. Therefore neither can any adjustment of the resilient force of the torsion springs 27 be made in this rear position. At the same time, the abovementioned construction elements are aligned to one another such that when the chair back frame 7 is in the rear position the block 48 lies freely in the rectangular opening 53 and does not contact the underside 57 of the seat plate 4.

If the chair back frame 7 swivels back into its front position (cf. FIG. 11 and 13), the distance 58 between the block 48 and the underside 57 of the seat plate 4 continues to lessen until the block 48 rests on the seat plate 4. The underside 57 of the seat plate 4 is designed correspondingly.

If the chair back frame 7 then swivels further into its front position (see direction of pivoting 25 in FIG. 7) the block 48 collides with the immovable seat plate 4. Since the contact slide 33 is supported by the free ends 51 of its T-legs 38 on the free legs 32 of the torsion springs 27, this causes sagging of the contact slide 33 in its top region, therefore in the region of the T-legs 38. At the same time, the more the contact slide 33 sags, the further the chair back frame 7 is pivoted back with its contact plate 22.

Figure 8:
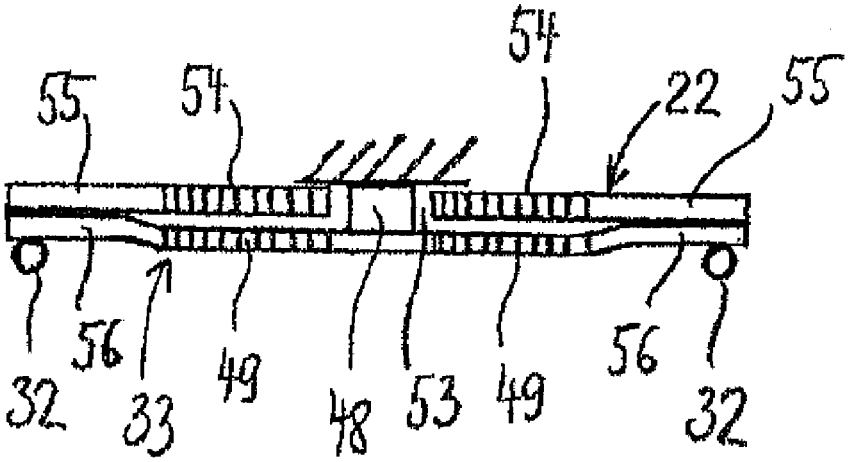
FIG. 8 shows a schematic illustration of the position of the contact slide in a front position.
Figure 9:
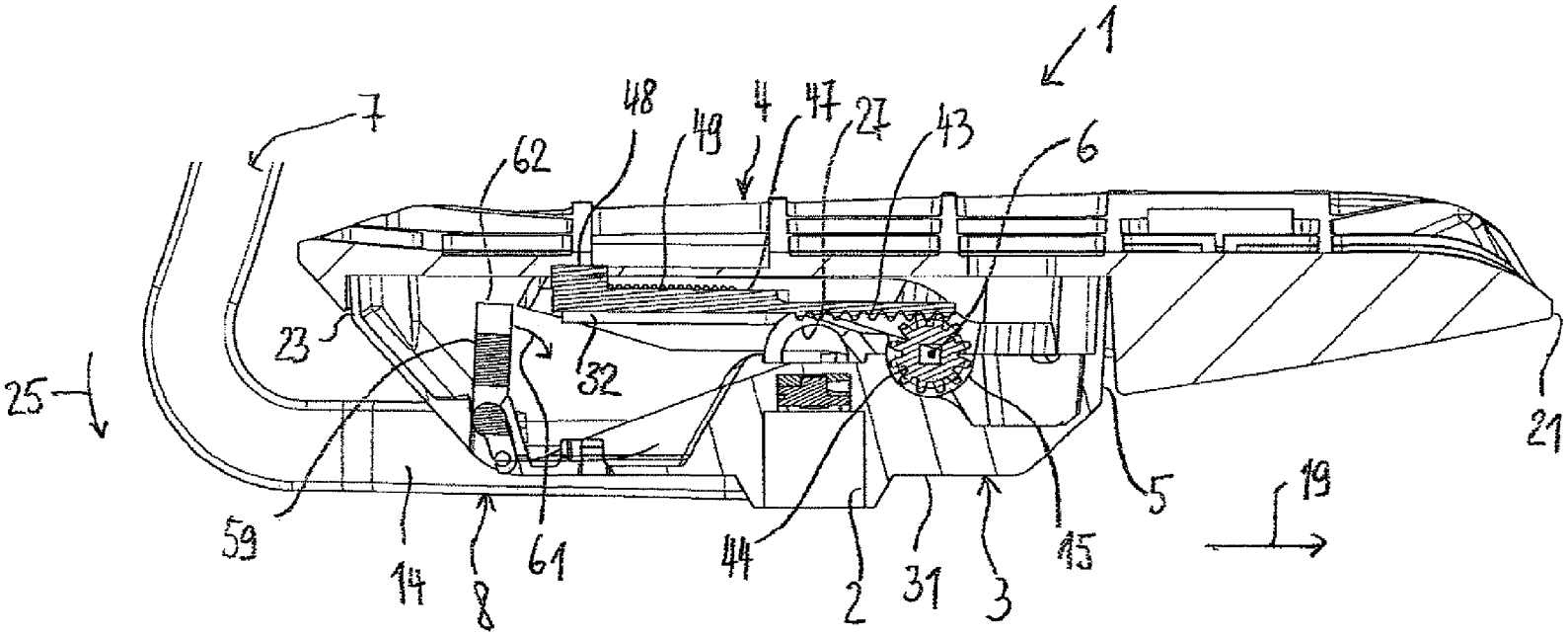
FIG. 9 shows a permanent contact mechanism in a sectional view along line IX-IX in FIG. 6.
Figure 10:
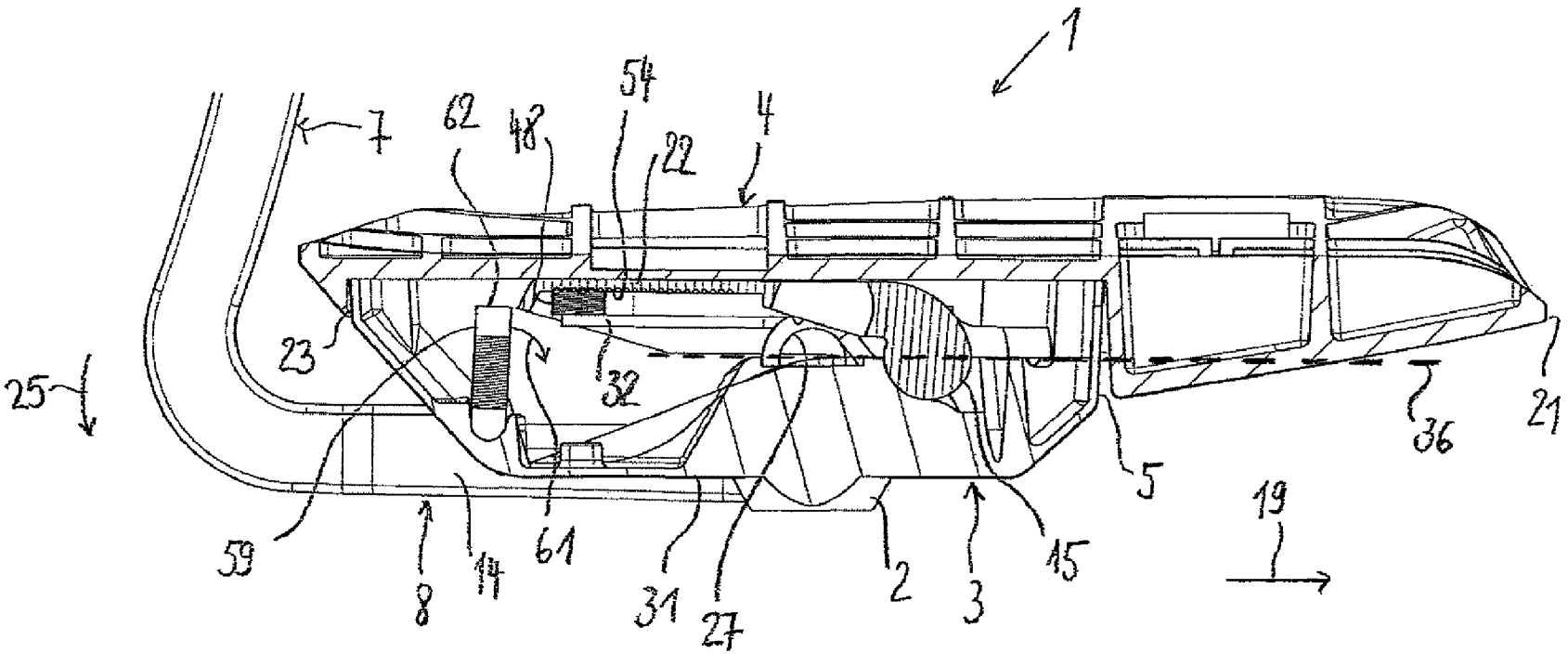
FIG. 10 shows a permanent contact mechanism in a sectional view along line X-X in FIG. 6.
Figure 11:
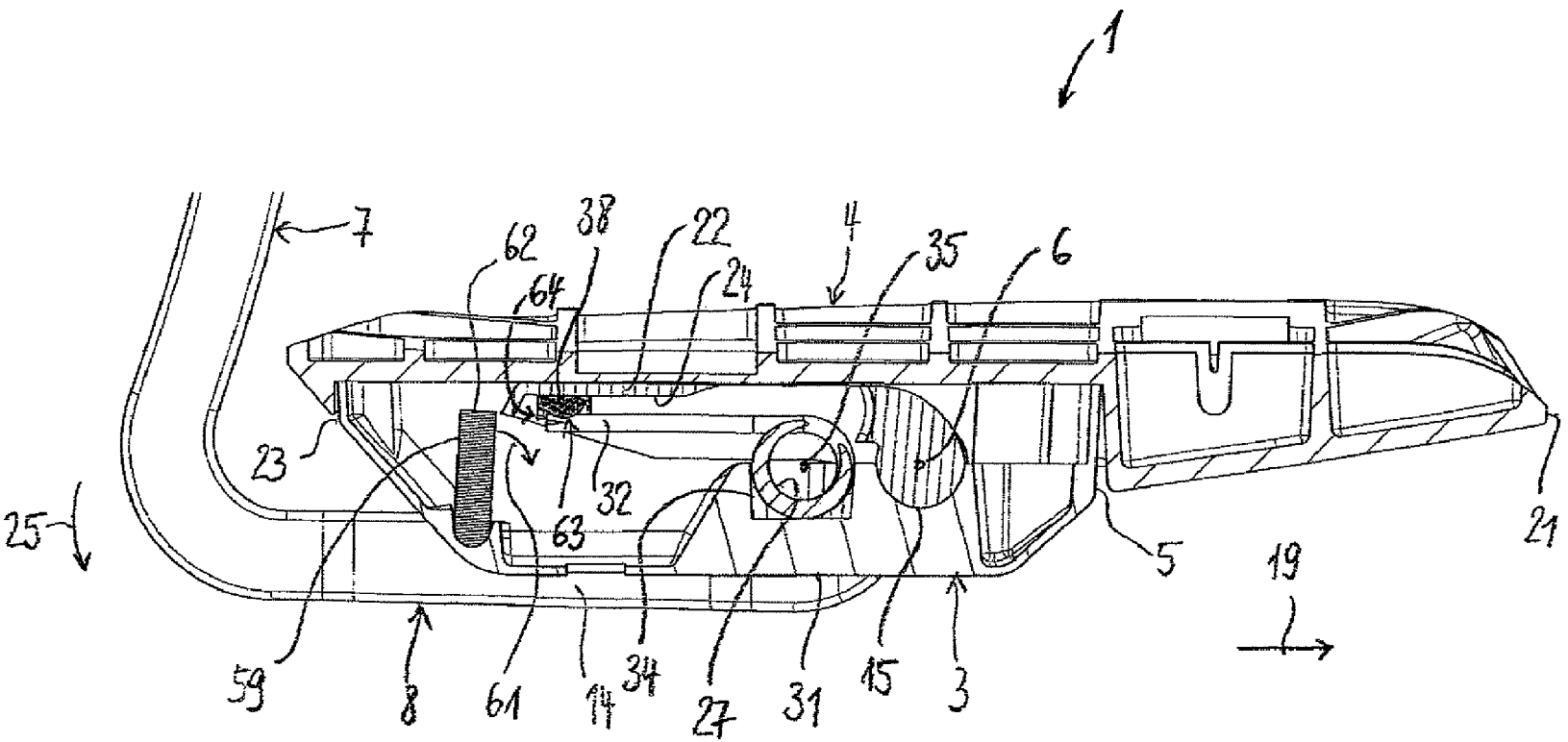
FIG. 11 shows a permanent contact mechanism in a sectional view along line XI-XI in FIG. 6 in a front position in an "easy" setting.
Figure 12:
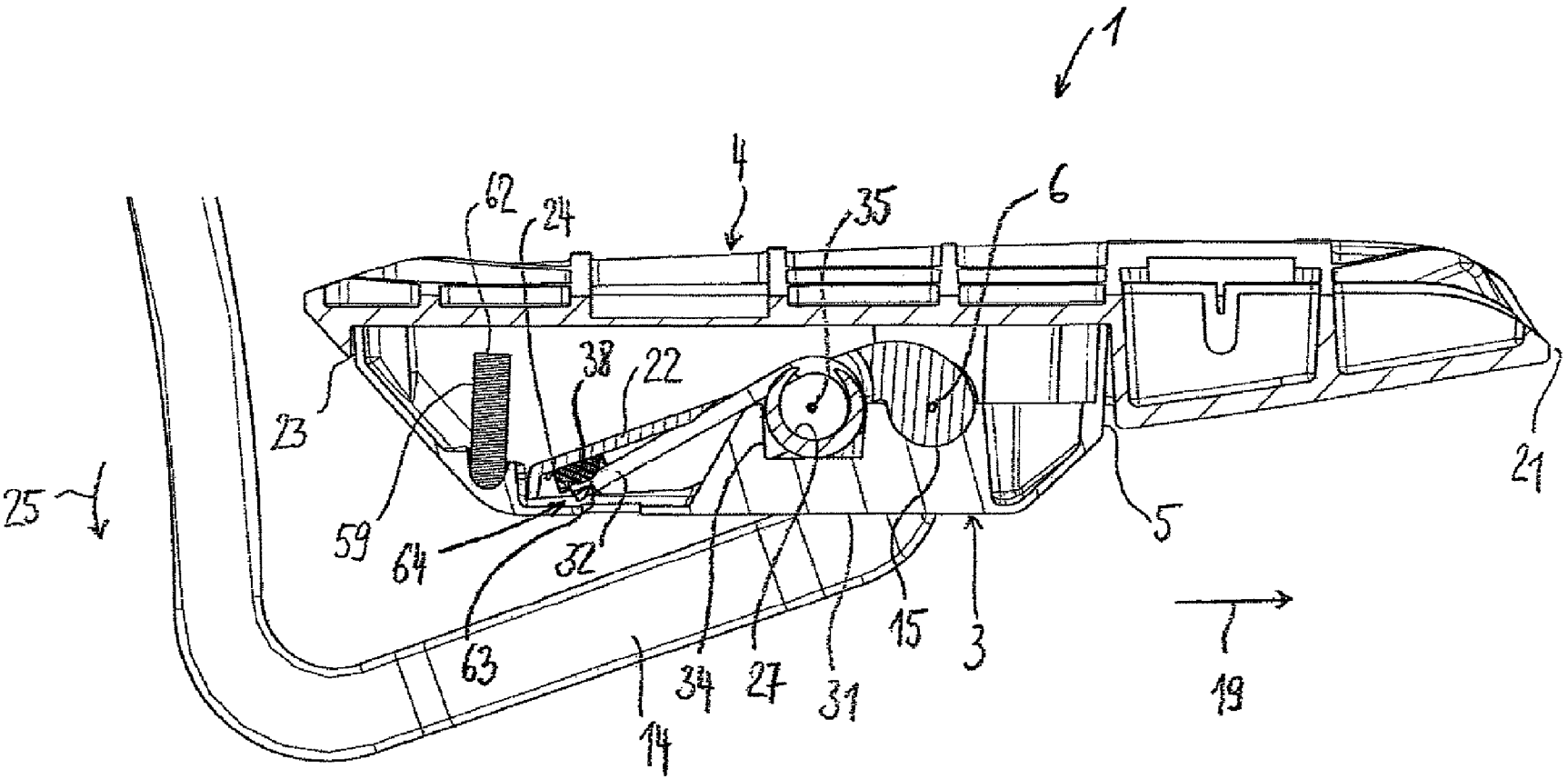
FIG. 12 shows a permanent contact mechanism in a sectional view along line XI-XI in FIG. 6 in a rear position in an "easy" setting.

If the chair back frame 7 is swung back into its starting position the smooth outer regions 56 of the T-legs 38 of the contact slide 33 are still resting on the smooth edge regions 55 of the latch plate underside 24. The latch elements 49, 54 of contact slide 33 and latch plate 22 are however no longer meshed in one another, but lie free, cf. FIG. 8. Since there are no shearing forces in this position, meshing is also no longer necessary. No force constituents of the torsion springs 27 are acting on the contact slide 33 in the direction of the trailing edge 23 of the seat frame 3, since chair back frame 7 and torsion springs 27 are lying parallel to one another and the angle of rotation is zero.

As a result, this means that the contact slide 33 can now be moved in the longitudinal direction 19. Adjustment of the resilient force of the torsion springs 27 can now occur.

Blocking wedges 59 act to fix the front position, and are arranged inside the seat frame 3 on a blocking device 60 and can be pivoted in the direction of pivoting 61 from a rest position to a blocking position, in which they engage with their free ends 62 on the underside 24 of the latch plate 22 and prevent pivoting of the latch plate 22 and thus pivoting of the chair back frame 7. The blocking wedges 59 can be actuated by means of an actuating element, not illustrated in greater detail, from outside the seat frame 3. For this, a fastening for a Bowden cable is provided on the blocking device 60, by means of which the blocking device can be pivoted altogether.

With further pivoting of the chair back frame 7 rearwards separation of the block 48 from the underside 57 of the seat plate 4 occurs. This results in the contact slide 33 again being released and approaching the underside 24 of the latch plate 22. The latch elements 49, 54 engage again so that adjusting the resilient force of the torsion springs 27 is no longer possible.

The cog 44 is actuated to adjust the resilient force in the front position, whereby a position change of the contact slide 33 occurs in a longitudinal direction 19. At the same time, the positions of the U-shaped grooves 39 on the free legs 32 of the torsion springs 27 change, and thus the articulation points 63 of the torsion springs 27 on the chair back frame 7 which rests on the contact slide 33.

The resilient force adjustment now takes place "feebly" according to the invention, specifically such that the length of the effective lever arm—therefore of the smallest, i.e. vertical distance between the line of influence of the resilient force and the fulcrum 35—can be changed by a change in position of the articulation points 63 of the free leg 32 of the torsion springs 27 on the latch plate 33 of the chair back frame 7, without effort having to be directed against the resilient force of the torsion springs 27. This enables particularly easy resilient force adjustment.

The permanent contact mechanism can be set to "easy" or "hard". With an "easy" setting (as shown in FIGS. 4, 5, 9, 10, 11 and 12) the articulation points 63 are pushed in the grooves 39 on the T-legs 38 by means of the rack gear in the direction of the free ends 64 of the free legs 32 of the torsion springs 27, resulting in comparatively long lever arms. The force constituents of the torsion springs 27 acting on the contact slide 33 in the direction of the trailing edge 23 of the seat frame 3 in the pivoted state (cf. FIG. 12) are comparatively minimal.

Figure 13:
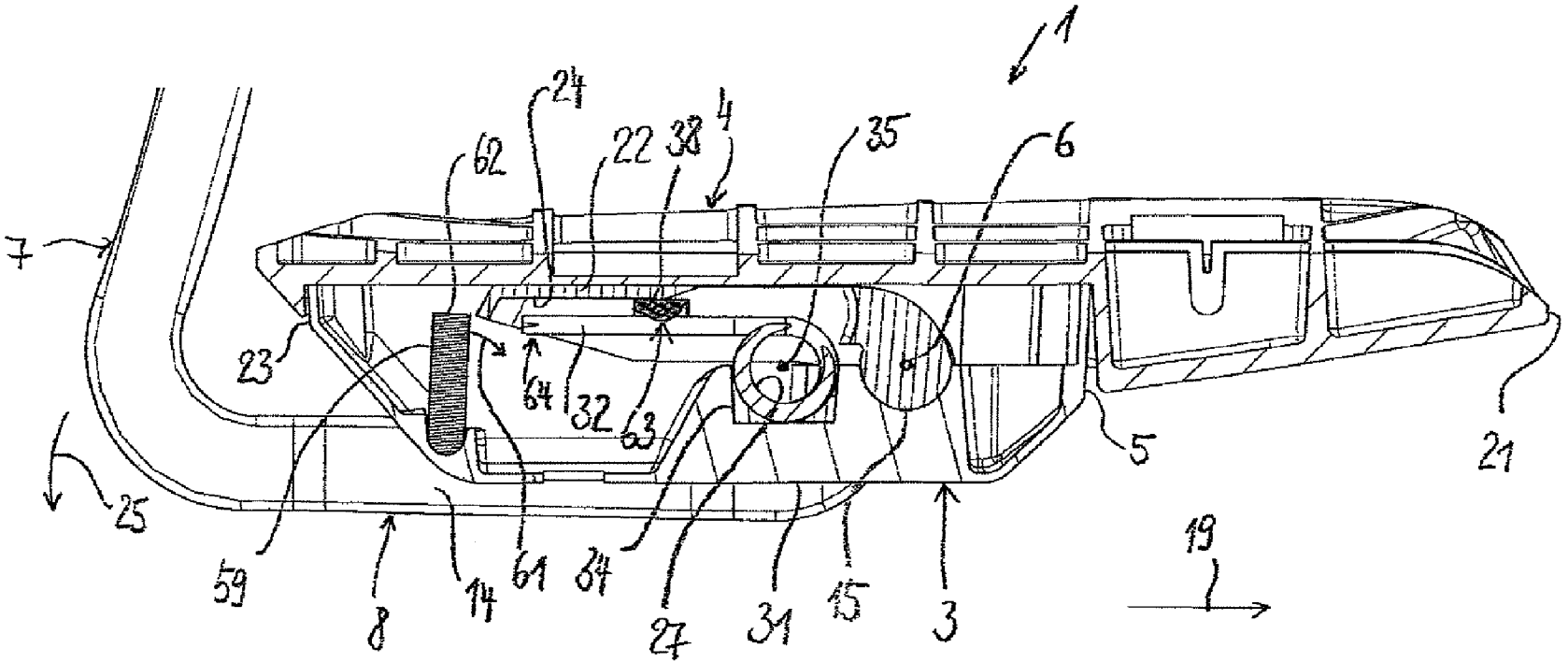
FIG. 13 shows a permanent contact mechanism in a sectional view along line XI-XI in FIG. 6 in a front position in a "harder" setting, und
Figure 14:
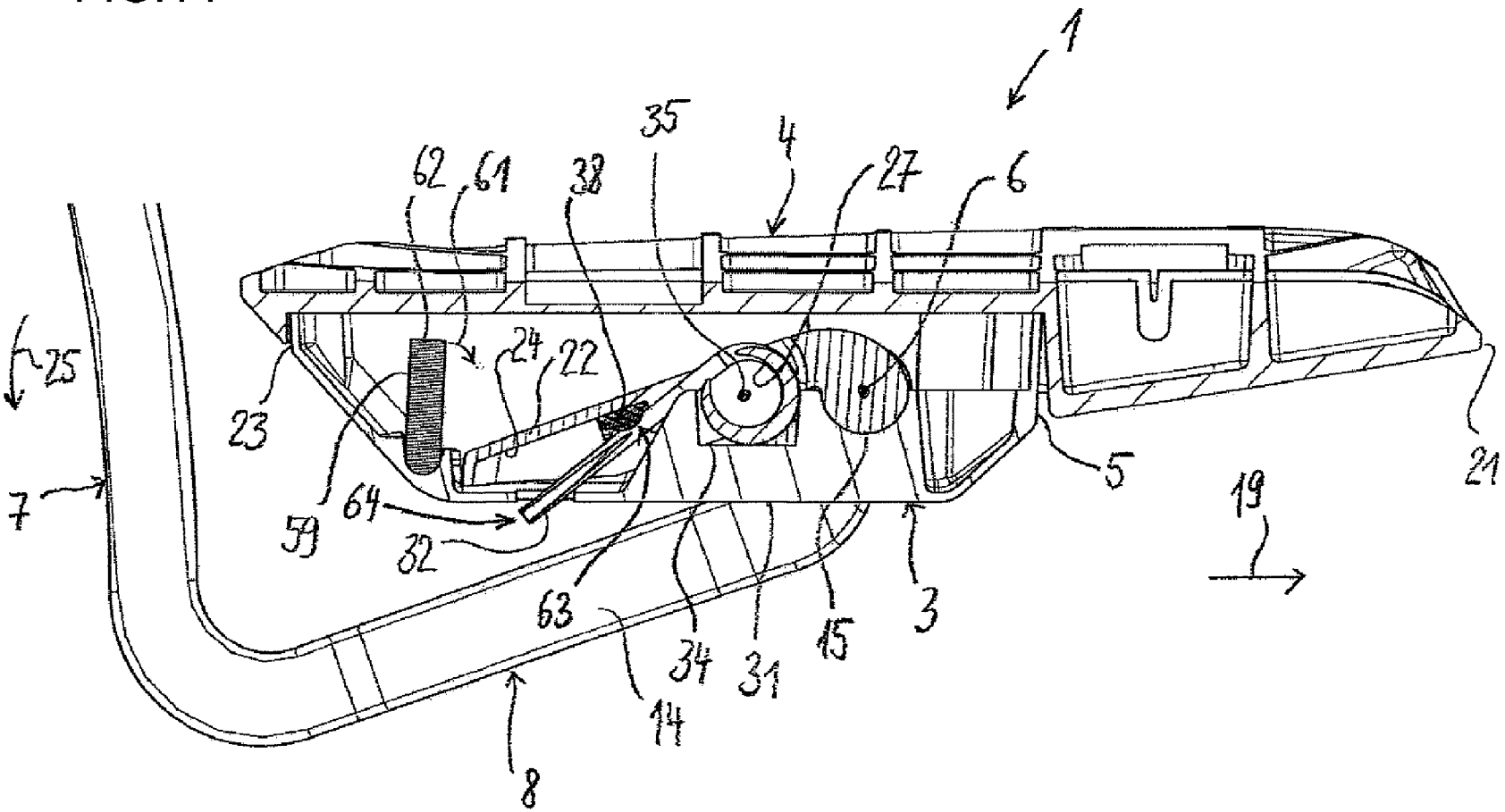
FIG. 14 shows a permanent contact mechanism in a sectional view along line XI-XI in FIG. 6 in a rear position in a "harder" setting.

In the case of "hard" setting (as shown in FIGS. 13 and 14) the articulation points 63 are shifted by means of the rack gear in the direction of the fulcrums 35 of the torsion springs 27, resulting in comparatively short lever arms. The force constituents of the torsion springs 27 acting on the contact slide 33 in the direction of the trailing edge 23 of the seat frame 3 in the pivoted state (cf. FIG. 12) are comparatively big.

The construction described in the present invention provides a permanent contact mechanism 1 which has an extremely flat structural form. This is accomplished substantially by the inventive separation of the position of the fulcrum 35 of the torsion springs 27 from the position of the pivot axis 6 of the chair back frame 7.

Instead of an intrinsically resilient lever element, such as the torsion spring 27 used here, other constructive arrangements can understandably also be employed to achieve the inventive function. Non-resilient construction parts can also be used in particular as lever elements which are impacted by a spring, for example a draw or compression spring.

Legend

1 permanent contact mechanism
2 conical flange
3 seat frame
4 seat plate
5 leading edge of the seat frame
6 pivot axis of the chair back frame
7 chair back frame
8 bearer
9 chair back
10 (free)

11 cradle
12 pivot axis of chair back
13 front end of the chair back frame
14 bearer main element
15 crossmember
16 recess
17 corresponding part
18 recess
19 longitudinal direction
20 (free)
21 seat leading edge
22 latch plate
23 trailing edge of the seat frame
24 underside of the latch plate
25 direction of pivoting
26 transverse direction
27 torsion spring
28 fixed leg
29 opening
30 (free)
31 underside of the seat frame
32 free leg
33 contact slide
34 prism
35 middle point of the torsion spring
36 horizontal plane
37 underside of the T-leg
38 T-legs
39 groove
40 (free)
41 underside of the T base
42 T base
43 gear rack
44 cog
45 recess
46 shaft
47 top side of the contact slide
48 block
49 latch element
50 (free)
51 free end of the T-leg
52 top side of the T-leg
53 opening
54 latch element
55 edge region
56 outer region
57 underside of the seat plate
58 distance
59 blocking wedge
60 blocking device
61 direction of pivoting
62 free end of the blocking wedge
63 articulation point
64 free end of the free leg

The invention claimed is:

1. A permanent contact mechanism for a chair, comprising:

a seat frame placeable on a chair column;

a chair back frame disposed at said seat frame and pivotally mounted about a pivot axis;

at least one spring-loaded or intrinsically resilient lever element disposed to cooperate with said chair back frame such that said chair back frame pivots against a spring force; and said lever element having a lever fulcrum at a position different from a position of said pivot axis, the position of said lever fulcrum of said lever element being located directly above the chair column;

wherein a spring force of said lever element is adjustable by changing a length of an effective lever arm, without effort having to be directed against the spring force, by changing a position of an articulation point of a lever arm of said lever element on said chair back frame.

2. The permanent contact mechanism according to claim 1 configured for an office chair.

3. The permanent contact mechanism according to claim 1, wherein the position of said lever fulcrum of said lever element lies substantially on a horizontal plane with the position of said pivot axis.

4. The permanent contact mechanism according to claim 1, which comprises a contact element disposed between said chair back frame and the lever arm of said lever element, and wherein a change in the position of the articulation point is effected by shifting said contact element when said chair back frame is in a non-pivoted position.

5. The permanent contact mechanism according to claim 4, which comprises a locking device on said chair back frame configured to prevent a shifting of said contact element when said chair back frame is in a pivoted position.

* * * * *